US007126282B2

(12) United States Patent
Choi et al.

(10) Patent No.: US 7,126,282 B2
(45) Date of Patent: Oct. 24, 2006

(54) ELECTRODELESS LIGHTING SYSTEM

(75) Inventors: Joon-Sik Choi, Seoul (KR); Ji-Young Lee, Gyeonggi-Do (KR); Hyun-Jung Kim, Seoul (KR); Yong-Seog Jeon, Gyeonggi-Do (KR); Yun-Chul Jung, Gyeonggi-Do (KR); Seung-Yeup Hyun, Seoul (KR); Byeong-Ju Park, Seoul (KR); Ri-Na Hwang, Seoul (KR); Dae-Kyung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/029,372

(22) Filed: Jan. 6, 2005

(65) Prior Publication Data

US 2006/0066244 A1 Mar. 30, 2006

(30) Foreign Application Priority Data

Sep. 25, 2004 (KR) ..... 10-2004-0077650

(51) Int. Cl.
*H01J 19/80* (2006.01)
*H01J 25/50* (2006.01)

(52) U.S. Cl. ..... 315/39.51; 315/39

(58) Field of Classification Search ..... 315/39.65, 315/39.77, 39, 248, 39.51
See application file for complete search history.

(56) References Cited

U.S. PATENT DOCUMENTS

| | | | | |
|---|---|---|---|---|
| 5,841,233 | A | 11/1998 | Ury et al. | |
| 6,617,793 | B1 * | 9/2003 | Choi et al. | 315/39 |
| 6,617,806 | B1 * | 9/2003 | Kirkpatrick et al. | 315/248 |
| 6,734,638 | B1 * | 5/2004 | Kang et al. | 315/248 |
| 2002/0105276 | A1 * | 8/2002 | Jeon | 315/5.13 |
| 2003/0043583 | A1 * | 3/2003 | Lee et al. | 362/263 |

FOREIGN PATENT DOCUMENTS

JP 2003-022786 1/2003

* cited by examiner

*Primary Examiner*—Don Wong
*Assistant Examiner*—Angela M Lie
(74) *Attorney, Agent, or Firm*—Greenblum & Bernstein, P.L.C.

(57) ABSTRACT

An electrodeless lighting system includes: a waveguide for guiding microwave energy generated from a microwave generator; and a resonator formed in a mesh structure allowing the microwave energy having passed the waveguide to resonate therein and passing light, and having around the bulb a microwave leakage preventing portion having a relatively low perforation ratio per unit area so that microwave energy is concentrated on the bulb positioned therein. Accordingly, leakage of microwaves is minimized and luminous efficiency is improved.

14 Claims, 4 Drawing Sheets

ELECTRODELESS LIGHTING SYSTEM

BACKGROUND OF THE INVENTION

1. Field of the Invention

The present invention relates to an electrodeless lighting system, and particularly, to an electrodeless lighting system provided with a resonator configured to minimize leakage of microwaves and improve luminous efficiency.

2. Description of the Background Art

In general, an electrodeless lighting system is an apparatus emitting visible light or ultraviolet light from an electrodeless plasma bulb upon applying microwave energy to the bulb. The electrodeless lighting system has a long life span and good lighting effect compared with an incandescent lamp or a fluorescent lamp which is generally used.

FIG. 1 is a longitudinal sectional view showing one example of a conventional electrodeless lighting system.

As shown, the conventional electrodeless lighting system using microwave energy includes: a case 1 forming a certain internal space; a microwave generator 2 mounted in the case 1, for generating microwave energy; a high voltage generator 3 for raising a common AC power to a high voltage and supplying the high voltage to the microwave generator 2; a waveguide 4 for guiding microwave energy generated at the microwave generator 2; a resonator 6 installed at an exit portion 4*a* of the waveguide 4 to communicate with the waveguide 4; and a bulb 5 positioned in the resonator 6 and emitting light as a filling material becomes a plasma by microwave energy transferred through the waveguide 4.

In addition, a reflecting mirror 7 for concentratively reflecting light generated at the bulb 5 to the front is provided in front of the case 1, a surrounding area of the resonator 6.

A dielectric mirror 8 is installed in the exist portion 4*a* of the waveguide 4, wherein the dielectric mirror 8 passes microwave energy transferred through the waveguide 4 and reflecting light emitted from the bulb 5 to the front. A hole 8*a* is formed at a central portion of the dielectric mirror 8 in order that a shaft portion 9 of the bulb 5 penetrates therethrough.

Meanwhile, a cooling fan 10 for cooling the microwave generator 2 and the high voltage generator 3 is provided at the rear of the case 1. And, in the drawing, non-explained reference number 11 indicates a fan motor, and 12 is a bulb motor for rotating the bulb 5.

As for the resonator 6 of the conventional electrodeless lighting system, a perforation ratio per unit area is adjusted to be sufficient to emit light from the bulb to the outside of the resonator.

Also, the size of each perforation constituting a mesh over the entire resonator 6 is determined on the basis of whether a perforation ratio required for light emission is achieved and whether microwave energy is not allowed to leak out of the resonator, simultaneously. As the perforation size of the resonator 6 is bigger, the performance of emitting light is better, but the performance of preventing the microwave energy leakage is worse. On the contrary, as the perforation size of the resonator 6 is smaller, the performance of emitting light is worse, but the performance of preventing the microwave energy leakage is better.

Thus, the conventional resonator 6 has a mesh structure formed of the same sized perforations over its entire area.

The conventional electrodeless lighting system having such a structure is operated as follows.

When a driving signal is inputted to the high voltage generator 3, the high voltage generator 3 raises AC power and supplies the raised high voltage to the microwave generator 2. The microwave generator 2 oscillates by a high voltage to thereby generate microwave energy having a very high frequency. The microwave energy generated in such a manner is guided through the waveguide 4 and is emitted into the resonator 6. The microwave energy emitted in the resonator 6 resonates in the resonator and also is strongly applied to a portion where the bulb 5 of the resonator 5 is positioned. At this time, by electrically discharging a material within the bulb 5, light having its own spectrum is generated. The light is reflected to the front by the reflecting mirror 7 and the dielectric mirror 8, thereby lighting a space.

However, because the conventional electrodeless lighting system is formed in a mesh structure having perforations of uniform sizes in order to achieve an optimum perforation ratio for an entire area of the resonator, when microwave energy is strongly applied around the bulb positioned in the resonator, the amount of microwave energy leaked to the outside of the resonator around the bulb is undesirably higher than that of other portions of the resonator.

Therefore, the amount of the microwave energy applied to the bulb is decreased, thereby degrading luminous efficiency of the bulb.

SUMMARY OF THE INVENTION

Therefore, an object of the present invention is to provide an electrodeless lighting system provided with a resonator configured to minimize leakage of microwaves and improve luminous efficiency.

To achieve these and other advantages and in accordance with the purpose of the present invention, as embodied and broadly described herein, there is provided an electrodeless lighting system comprising: a waveguide guiding microwave energy generated from a microwave generator; and a resonator formed in a mesh structure allowing the microwave energy having passed the waveguide to resonate therein and passing light, and having around the bulb a microwave leakage preventing portion having a relatively low perforation ratio per unit area so that microwave energy is concentrated on the bulb positioned therein.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of an electrodeless lighting system in accordance with the present invention, and hereinafter, the most preferable embodiment will now be described.

Figure 1:
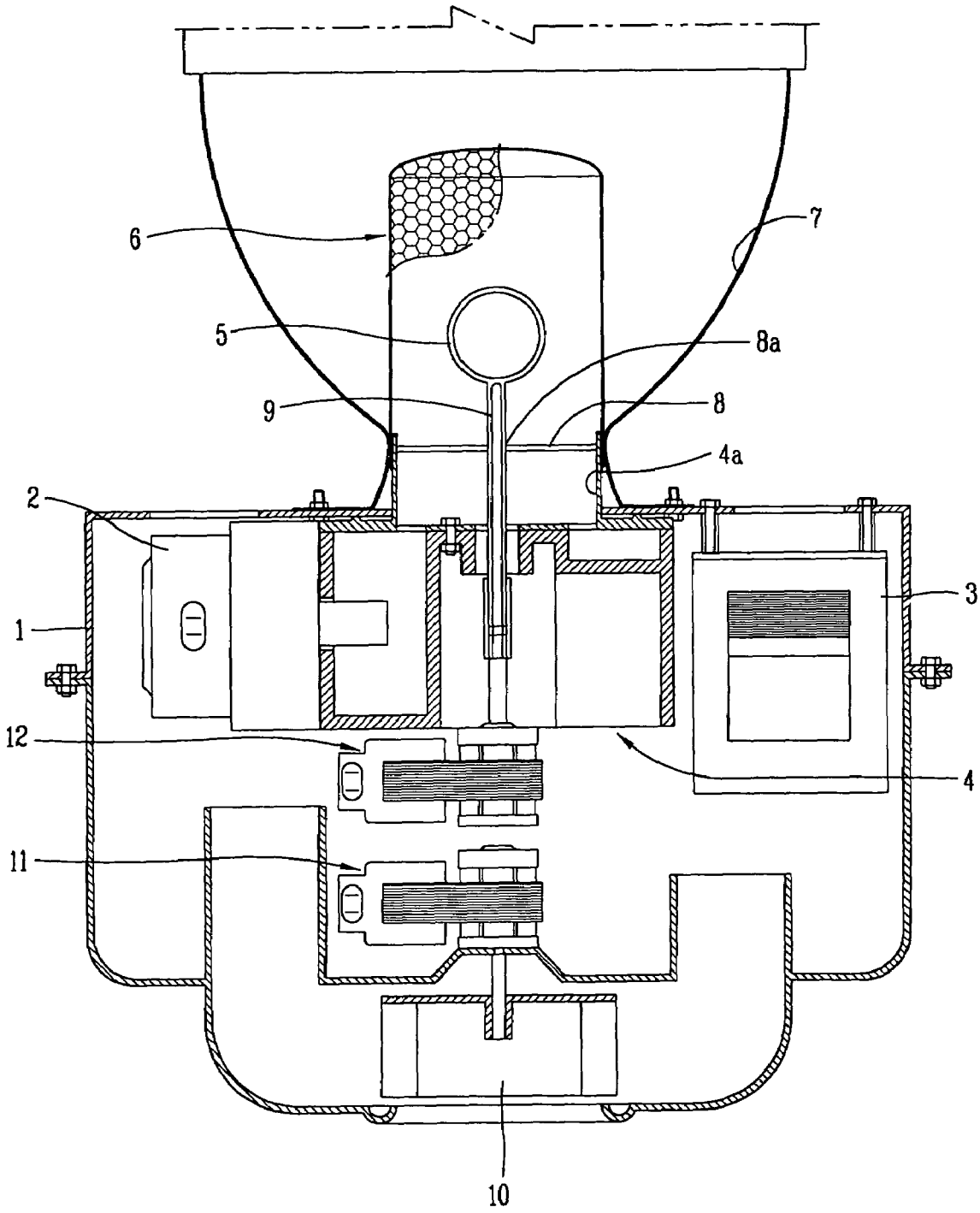
FIG. 1 CONVENTIONAL ART.
FIG. 1 is a sectional view showing a conventional electrodeless lighting system.
Figure 2:
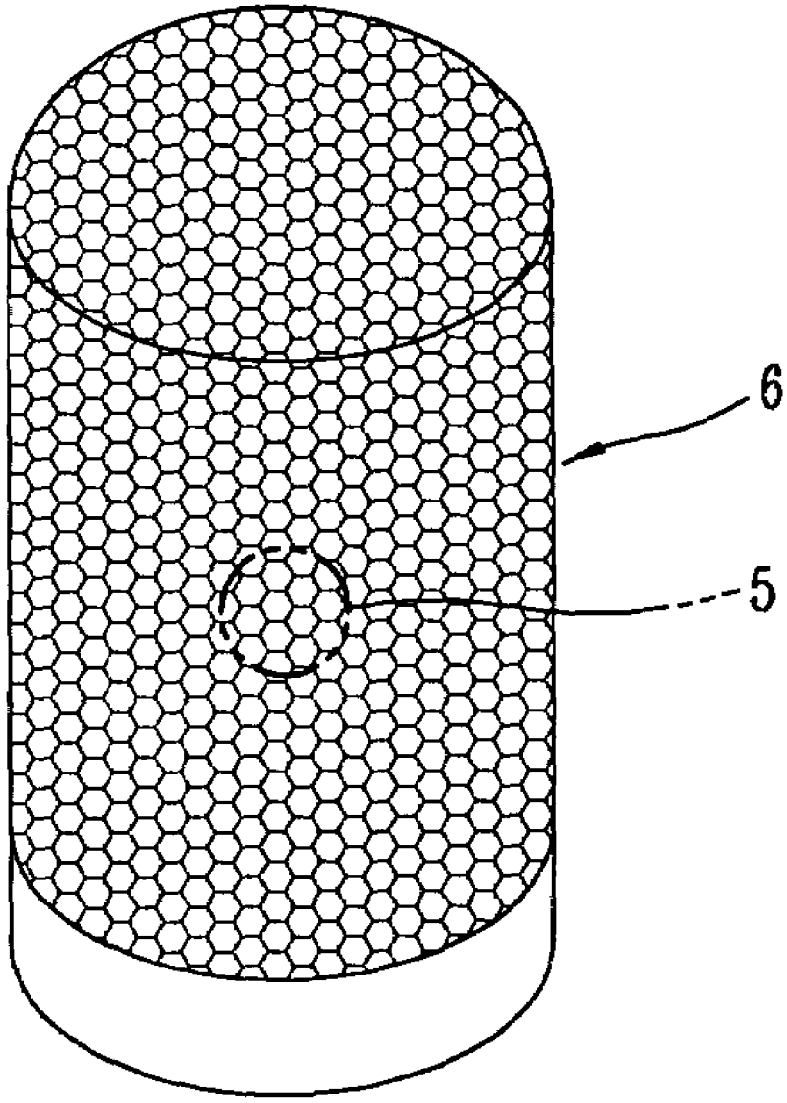
FIG. 2 CONVENTIONAL ART.
FIG. 2 is a perspective view showing a resonator of the electrodeless lighting system.
Figure 3:
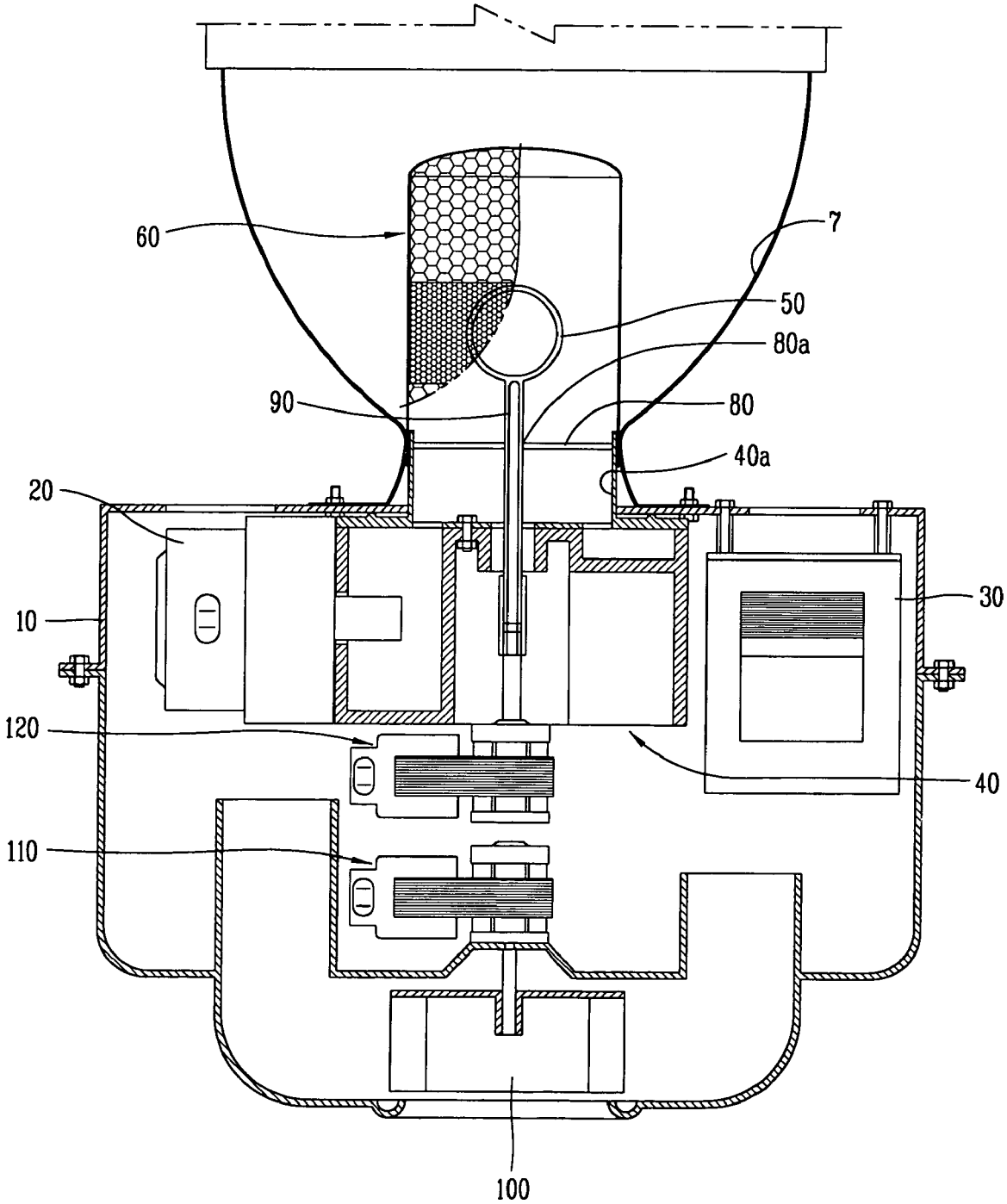
FIG. 3 is a sectional view showing one embodiment of an electrodeless lighting system in accordance with the present invention.
Figure 4:
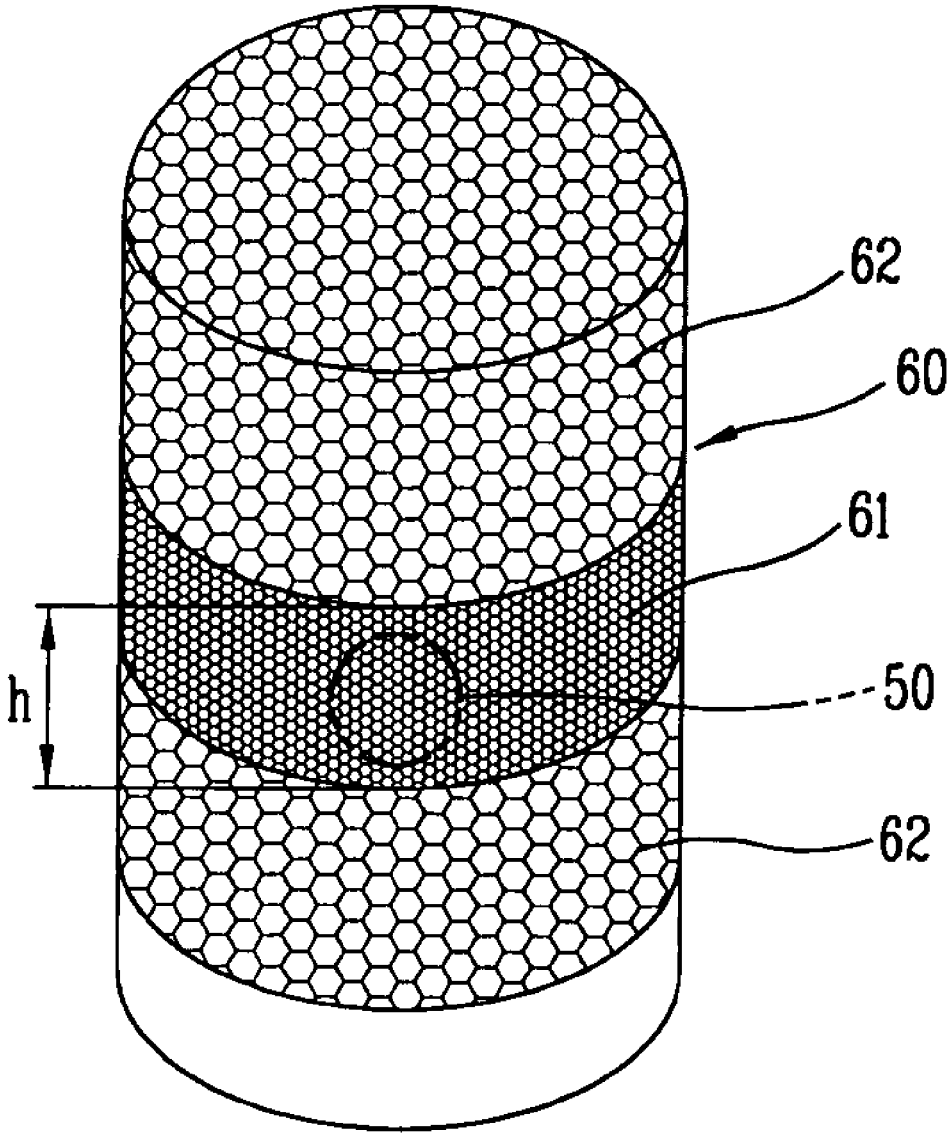
FIG. 4 is a perspective view showing a resonator of an electrodeless lighting system.

FIG. 3 is a sectional view showing one embodiment of an electrodeless lighting system in accordance with the present invention, and FIG. 4 is a perspective view showing a resonator of an electrodeless lighting system in accordance with one embodiment of the present invention.

As shown, the electrodeless lighting system in accordance with one embodiment of the present invention includes: a case 10 forming a certain internal space; a microwave generator 20 mounted in the case 10, for generating microwave energy; a high voltage generator 30 raising common AC power to a high voltage and supplying the high voltage to the microwave generator 30; a waveguide 40 guiding microwave energy generated at the microwave generator 20; a resonator 60 installed at an exist portion 40*a* of the waveguide 40 to communicate with the waveguide 40 and having a mesh structure that allows microwave energy having passed the waveguide 40 to resonate therein and passes light; and a bulb 50 positioned in the resonator 60 and generating light as a filling material becomes a plasma by microwave energy transferred through the waveguide 40.

In addition, a reflecting mirror 70 for concentratively reflecting light generated at the bulb 50 to the front is provided in front of the case 10, a surrounding area of the resonator 60.

A dielectric mirror 80 that passes microwave energy transferred through the waveguide 40 and reflects light emitted from the bulb 50 to the front is installed in the exit portion 40*a* of the waveguide 40. A hole 80*a* through which a shaft portion of the bulb 50 penetrates is formed at a central portion of the dielectric mirror 80.

Meanwhile, a cooling fan 100 for cooling the microwave generator 20 and the high voltage generator 30 is provided at the rear of the case 10. And, in the drawing, non-explained reference number 110 indicates a fan motor, and 120 is a bulb motor for rotating the bulb 50.

Here, the resonator 60 having the mesh structure is constructed as follows.

As shown in FIG. 4, around the bulb 50, the resonator 60 has a microwave leakage preventing portion 61 having a relatively low perforation ratio per unit area, so that microwave energy is concentrated on the bulb 60 positioned in the resonator 60.

Also, a resonator portion 62 except the microwave leakage preventing portion 61 is formed in a mesh structure having a perforation ratio per unit area, which is relatively higher than that of the microwave leakage preventing portion 61 in order to compensate the quantity of light lost by the microwave leakage preventing portion 61.

Preferably, the resonator 61 is formed in a cylindrical shape, but it may be formed as a many-sided column shape depending on a design.

The microwave leakage preventing portion 61 is formed around the bulb 50 at a certain width (h) in a circumferential direction of the resonator 60. At this time, preferably, a width (h) of the microwave leakage preventing portion is greater than a diameter of the bulb, so that microwave energy is strongly applied to the bulb.

Also, the perforation ratio per unit area of the microwave leakage preventing portion may gradually decrease toward the center of the bulb in a longitudinal direction of the resonator. According to a design, the perforation ratio per unit area may be even, or the microwave leakage preventing portion 61 may have a solid structure without a perforation.

Also, although not shown in the drawing, the resonator may be formed with its perforation ratio per unit area gradually decreasing toward the center of the bulb. Hereinafter, the operation of the electrodeless lighting system in accordance with the present invention will now be described.

When a driving signal is inputted to the high voltage generator 30, the high voltage generator 30 raises AC power and supplies a high voltage to the microwave generator 20, and the microwave generator 20 oscillates by the high voltage, thereby generating microwave energy having a very high frequency. The microwave energy generated in such a manner is emitted into the resonator 60 by being guided through the waveguide 40. The microwave energy emitted into the resonator 60 distributes a strong electric field in the resonator 60. At this time, leakage of the microwave energy is minimized by the microwave leakage preventing portion 61 of the resonator 60. Accordingly to this, a strong electric field is formed around the bulb 50, and thus the microwave energy is concentrated. After all, it is more activated that the filling material of the bulb 50 becomes a plasma. Thus, the light generated from the bulb 50 is effectively emitted to the outside of the resonator 60 through the microwave leakage preventing portion 61 and the remaining portion 62 of the resonator whose perforation ratio per unit area is relatively high. The light makes a space bright by being reflected to the front by the reflecting mirror 70 and the dielectric mirror 80.

As so far described, the electrodeless lighting system in accordance with the present invention employs a resonator having around the electrodeless bulb a microwave leakage preventing portion formed in a mesh structure with a low perforation ratio per unit area. Accordingly, the amount of microwave leaked to the outside of the resonator is decreased, and a strong electric field is more effectively formed around the bulb. Thus, microwave energy is concentrated on the bulb, and it is activated that a filling material of the bulb becomes a plasma.

Also, a remaining portion of the resonator except the microwave leakage preventing portion has a perforation ratio per unit area of the microwave leakage preventing portion, which is relatively higher than that of the microwave leakage preventing portion. Accordingly, the light transmittance to the outside of the resonator is improved.

Accordingly, the intensity of light generated from the electrodeless bulb increases, and the quantity of light emitted to the outside of the resonator also increases, thereby remarkably improving luminous efficiency of the electrodeless lighting system.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a waveguide that guides microwave energy generated by a microwave generator; and a resonator, formed in a mesh structure, that allows the microwave energy guided by the waveguide to resonate therein and passes light emitted by a bulb positioned in the resonator, the resonator comprising a perforated microwave leakage preventer, disposed around the bulb, having a perforation per unit area ratio lower than a perforation per unit area ratio of a part of the resonator located above the microwave leakage preventer, such that microwave energy is concentrated on the bulb.

2. The electrodeless lighting system of claim 1, wherein the resonator comprises a cylindrical shape, and the microwave leakage preventer has a certain width.

3. The electrodeless lighting system of claim 2, wherein the width of the microwave leakage preventer is greater than a diameter of the bulb.

4. The electrodeless lighting system of claim 1, wherein a perforation per unit area ratio of the microwave leakage preventer gradually decreases toward a center of the bulb along a longitudinal direction of the resonator.

5. The electrodeless lighting system of claim 1, wherein sizes of penetrations of the microwave leakage preventer are uniform.

6. The electrodeless lighting system of claim 1, wherein the other parts of the resonator emit enough light to compensate for an amount of light blocked by the microwave leakage preventer.

7. The electrodeless lighting system of claim 1, wherein the resonator has a perforation per unit area ratio which gradually decreases toward a center of the bulb.

8. A resonator for an electrodeless lighting system, formed in a mesh structure, that allows microwave energy to resonate therein and passes light emitted by a bulb positioned in the resonator, comprising:

a perforated microwave leakage preventer, disposed around the bulb, having a perforation per unit area ratio lower than a perforation per unit area ratio of a part of the resonator located above the microwave leakage preventer, such that microwave energy is concentrated on the bulb.

9. The resonator of claim 8, wherein the resonator comprises a cylindrical shape, and the microwave leakage preventer has a certain width.

10. The resonator of claim 9, wherein the width of the microwave leakage preventer is greater than a diameter of the bulb.

11. The resonator of claim 8, wherein a perforation per unit area ratio of the microwave leakage preventer gradually decreases toward a center of the bulb along a longitudinal direction of the resonator.

12. The electrodeless lighting system of claim 8, wherein sizes of penetrations of the microwave leakage preventer are uniform.

13. The electrodeless lighting system of claim 8, wherein the other parts of the resonator emit enough light to compensate for an amount of light blocked by the microwave leakage preventer.

14. The electrodeless lighting system of claim 8, wherein the resonator has a perforation per unit area ratio which gradually decreases toward a center of the bulb.

* * * * *

UNITED STATES PATENT AND TRADEMARK OFFICE

CERTIFICATE OF CORRECTION

PATENT NO. : 7,126,282 B2
APPLICATION NO. : 11/029372
DATED : October 24, 2006
INVENTOR(S) : Joon-Sik Choi et al.

It is certified that error appears in the above-identified patent and that said Letters Patent is hereby corrected as shown below:

On the cover of the printed patent, Item (56), References Cited, the following should be added,

-- OTHER PUBLICATIONS

English language abstract of JP 2003-022786--.

Signed and Sealed this

Eleventh Day of December, 2007

JON W. DUDAS
*Director of the United States Patent and Trademark Office*